United States Patent [19]

Ramey

[11] 4,136,685

[45] Jan. 30, 1979

[54] CUSHIONED VIBRATING MEANS

[75] Inventor: Carol Ramey, 6413 Ocean Front Walk, Playa Del Ray, Calif. 90291

[73] Assignee: Carol Ramey, Playa Del Rey, Calif.

[21] Appl. No.: 737,797

[22] Filed: Nov. 2, 1976

[51] Int. Cl.[2] ..... A61H 1/00

[52] U.S. Cl. ..... 128/33

[58] Field of Search ..... 128/33–36, 128/24.1, 24.2, 25 B

[56] References Cited

U.S. PATENT DOCUMENTS

| | | | |
|---|---|---|---|
| 2,096,646 | 10/1937 | Thornton-Norris | 128/25 B |
| 2,687,718 | 8/1954 | Britton et al. | 128/36 |
| 2,902,993 | 9/1959 | Wagner | 128/25 B |
| 3,115,139 | 12/1963 | Schneider | 128/36 UX |

*Primary Examiner*—Lawrence W. Trapp
*Attorney, Agent, or Firm*—I. Morley Drucker

[57] ABSTRACT

The combination of a pressure-switch operated vibrating motor, enclosed within a cushioning material, such as synthetic or natural foam, having an enlarged surface area relative to that of the motor. As a person applies pressure on said enlarged cushioning means, as by leaning on the cushion, the pressure switch is engaged to close a circuit thereby starting the vibrating motor enclosed within the cushioning means. The cushioning means acts as a damping means for the vibrating motor for greater comfort than would otherwise occur if the vibrating motor were not so enclosed.

6 Claims, 4 Drawing Figures

CUSHIONED VIBRATING MEANS

BACKGROUND OF THE INVENTION

Hand-held motorized vibrators are well known for the purpose of relaxing and increasing blood circulation of the human body. However, to the best of my knowledge, cushioned motorized vibrators, designed to operate by virtue of the application of a person's weight, are not known, but would constitute a substantial advance in the art.

SUMMARY OF THE INVENTION

This invention is directed towards the combination of a pressure-switch operated vibrating motor, enclosed within a cushioning material, such as synthetic or natural foam, having an enlarged surface area relative to that of the motor. As a person applies pressure on said enlarged cushioning means, as by leaning on the cushion, the pressure switch is engaged to close a circuit thereby starting the vibrating motor enclosed within the cushioning means.

The vibrating motor causes the vibrator to be transmitted to the cushioning material in a damped fashion, and the entire surface of the cushioning commences to vibrate in a damped fashion offering great comfort to the user.

DETAILED DESCRIPTION OF THE PREFERRED EMBODIMENT

Figure 1:
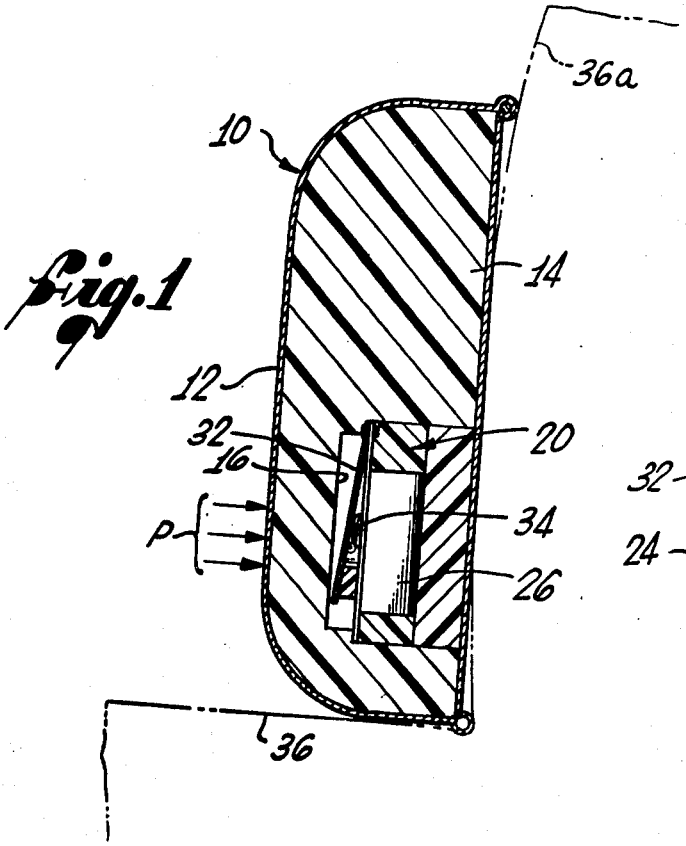
FIG. 1 is an end elevational view, in cross-section, of a pillow or cushion of this invention within which is enclosed a pressure-switch operated motorized vibrator.
Figure 2:
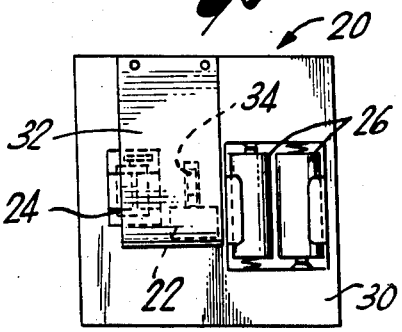
FIG. 2 is a plan view of one embodiment of a motorized vibrator employed in this invention.
Figure 3:
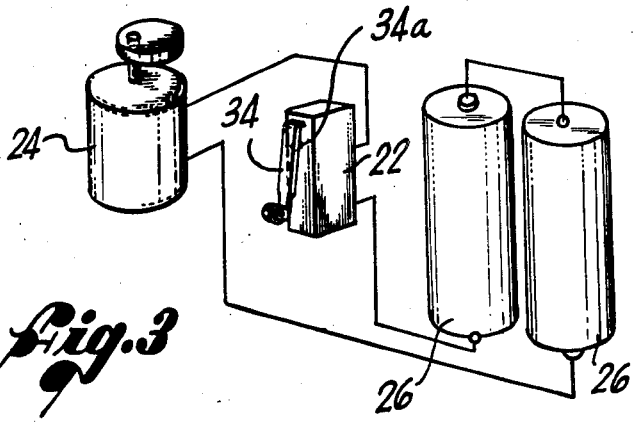
FIG. 3 is a schematic view of the motorized vibrator employed in this invention, showing the electrical interconnection between power source, pressure switch and vibrating motor.

Referring particularly to FIGS. 1-3, the cushioned vibrating means, or vibrating cushion is designated generally by the numeral 10. The vibrating cushion 10 comprises, preferably, a surface covering 12 made of fabric, plastic, reinforced plastic, or fur, and a foam interior 14. The foam interior 14 is, preferably, made of a compressible synthetic foam (e.g., polyurethane) or a natural rubber foam material. A pocket 16 is formed in the foam material 14 for the insertion, and complete enclosure, of a pressure-switch operated motorized vibrator unit 20.

The vibrator unit 20 comprises a small vibrating motor 24, of conventional design, electrically connected, through a pressure switch means 22, to a power source constituting, preferably, two or more series-connected dry cell batteries 26. The motor 24, pressure switch means 22 and batteries 26 are stably mounted in a rigid plastic or metal housing 30.

A flexible plastic pressure plate 32, of relatively large surface area compared to switch means 22, has one end mounted to the housing 30, and overlies the pressure switch means 22.

Upon the application of an inwardly directed force P (see FIG. 1) upon cushion 10, the foam interior 14 is compressed and exerts pressure on pressure plate 32, which, in turn, depresses a leaf spring switch 34, **34*a*, on the switch means 22, to start the vibrating motor 24. It is to be noted that pressure plate 32 lies in a position in which it can make unobstructed contact with the pressure switch means 22 upon application of force P upon the cushion 10. The motor 24 will immediately commence vibrating, upon depression of pressure plate 32, and the vibrations will be transmitted, in damped fashion, over the entire exposed surface area of the cushion. Upon release of the inward force on the cushion 10, the leaf spring switch 34 reverts to the normal open position shown in FIG. 3 to thereby open the electrical circuit and stop the motor 24**.

The cushion 10 may be attached to furniture, car seat or the like, or may be a wholly separate unit. The phantom lines 36, **36*a*, in FIG. 1 designated the seat and back, respectively, of a car seat or uholstered furniture, to which the cushion 10** is shown as removably attached, by way of example only.

The motor unit 20 may be readily removed from cushion 10 by unfastening a zipper sewn in fabric 12, or by other suitable means.

Figure 4:
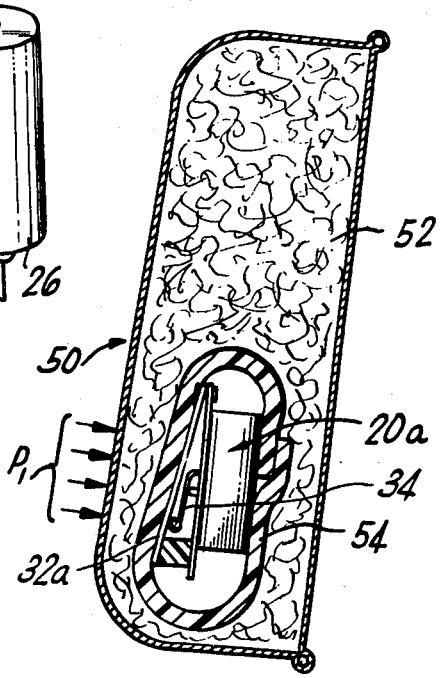
FIG. 4 is an end elevational view in cross-section, of a second embodiment of this invention.

A second embodiment of the vibrating cushion of this invention is shown in FIG. 4. In this embodiment, the cushion 50 has an interior comprising, mainly, of nonwoven natural or synthetic roving material 52. The vibrating motor unit **20*a* is substantially identical to that of motor unit 20 of FIGS. 1 and 3. The motor unit 20*a* is encased within a band of natural or synthetic compressible foam material 54. The cushion 50 is caused to vibrate in substantially the same manner as cushion 10, upon the application of force $P_1$, with damped vibrating motion of the cushion 50 resulting, as in the case of cushion 10**.

Modifications of the foregoing will become apparent to those skilled in the art. However, I intend to be bound only by the scope of the claims which follow.

I claim:

1. A self-contained cushioned vibrating means, which comprises:

a vibratory motor means;

a portable power source;

a pressure-sensitive switching means electrically connected to said vibratory motor means, and to said portable power source for energization and de-energization of said vibratory motor means;

a pressure plate means directly overlying said pressure-sensitive switching means and having a relatively enlarged surface area with respect to said pressure-sensitive switching means; and a compressible cushioning material completely enclosing said vibratory motor means portable power source, said pressure-sensitive means and said pressure plate means whereby upon the application of external inwardly directed force at any one of a multiplicity of areas on the surface of said compressible cushioning material said pressure plate means is forced into contact with said pressure-sensitive switching means to thereby energize said vibratory motor means for transmission of vibrations, in a damped manner, to the surface of said cushioning material and upon release of said external inwardly directed force upon said compressible cushioning material said pressure plate means is released from contact with said pressure-sensitive switching means to thereby de-energize said vibratory motor means.

2. The cushioned vibrating means of claim 1 wherein said cushioning material constitutes a discrete pillow.

3. The cushioned vibrating means of claim 1 which includes a separate surface covering overlying said cushioning material to form a discrete pillow.

4. The cushioned vibrating means of claim 3 wherein said separate surface covering is provided with access means for access to said vibrating motor means.

5. The cushioned vibrating means of claim 1 wherein said vibratory motor, power source and pressure-sensitive switch means are all mounted onto a common housing and said enlarged pressure plate means overlying said pressure-sensitive switch means is also mounted onto said common housing.

6. In a self-contained cushioned vibrating pillow means having a vibrating motor means, a pressure-sensitive switching means electrically interconnected to an internally mounted power source for energization of said vibrating motor means, and a compressible, cushioning material enclosing both said vibratory motor means, said power source, and said pressure-sensitive switching means, the improvement which comprises:

a pressure plate means interposed between said pressure-sensitive switching means and said cushioning material, said pressure plate having a relatively enlarged surface area with respect to said pressure switching means and being positioned in directly overlying relationship to said pressure-sensitive switching means, whereby application of inwardly directed manual force on a portion of the external surface of said cushioning material is, in turn, transmitted to said pressure plate and thence to said switching means for energization of said vibrating motor means.

* * * * *

UNITED STATES PATENT OFFICE

CERTIFICATE OF CORRECTION

PATENT NO. : 4,136,685

DATED : January 30, 1979

INVENTOR(S) : CAROL RAMEY

It is certified that error appears in the above-identified patent and that said Letters Patent are hereby corrected as shown below:

Column 2, line 53, after "means" insert --,-- (comma)

Column 2, line 54, after "pressure-sensitive" insert --switching--

Column 4, line 9, after "pressure" insert --sensitive--

Signed and Sealed this

*First* Day of *May 1979*

[SEAL]

*Attest:*

RUTH C. MASON
*Attesting Officer*

DONALD W. BANNER
*Commissioner of Patents and Trademarks*